United States Patent [19]

Fortney

[11] Patent Number: 4,964,323

[45] Date of Patent: Oct. 23, 1990

[54] BREAD CUTTING APPARATUS

[76] Inventor: Roger D. Fortney, 6421 Keelson Dr., Madison, Wis. 53705

[21] Appl. No.: 415,993

[22] Filed: Oct. 2, 1989

[51] Int. Cl.[5] ..... B26D 1/54

[52] U.S. Cl. ..... 83/167; 83/467.1; 83/468.6; 83/764

[58] Field of Search ..... 83/761, 762, 763, 764, 83/765, 823, 827, 167, 829, 870, 455, 454, 467.1, 468.6

[56] References Cited

U.S. PATENT DOCUMENTS

| | | | |
|---|---|---|---|
| 1,515,014 | 11/1924 | Downs | 83/762 |
| 2,362,737 | 11/1944 | Wood | 83/762 |
| 2,398,192 | 4/1946 | Scheminger, Jr. | 83/762 |
| 3,452,795 | 7/1969 | Davies | 83/762 |
| 4,056,026 | 11/1977 | Panaritis et al. | 83/762 |
| 4,085,642 | 4/1978 | Birmingham | 83/764 |
| 4,212,431 | 7/1980 | Doyel | 83/167 |

FOREIGN PATENT DOCUMENTS

| | | | |
|---|---|---|---|
| 444636 | 12/1974 | U.S.S.R. | 83/762 |

*Primary Examiner*—Frank T. Yost
*Assistant Examiner*—Scott A. Smith
*Attorney, Agent, or Firm*—Andrus, Sceales, Starke & Sawall

[57] ABSTRACT

A bread cutting device including an open top container or box and a tray is removably mounted on the box and includes a plurality of parallel spaced rails which supports a loaf of bread to be cut. A lateral back stop is mounted at one end of the box and extends upwardly from the tray in position to be engaged by the end of the loaf. A pair of slicing guides are received within spaces between adjacent rails and each guide includes a series of parallel slits which extend from the upper end of the guide to a location spaced from the lower end. A knife inserted in aligned slits in the guides will cut a slice from the loaf and the crumbs fall through the spaces between the rails for collection in the box.

12 Claims, 2 Drawing Sheets

FIG. 1
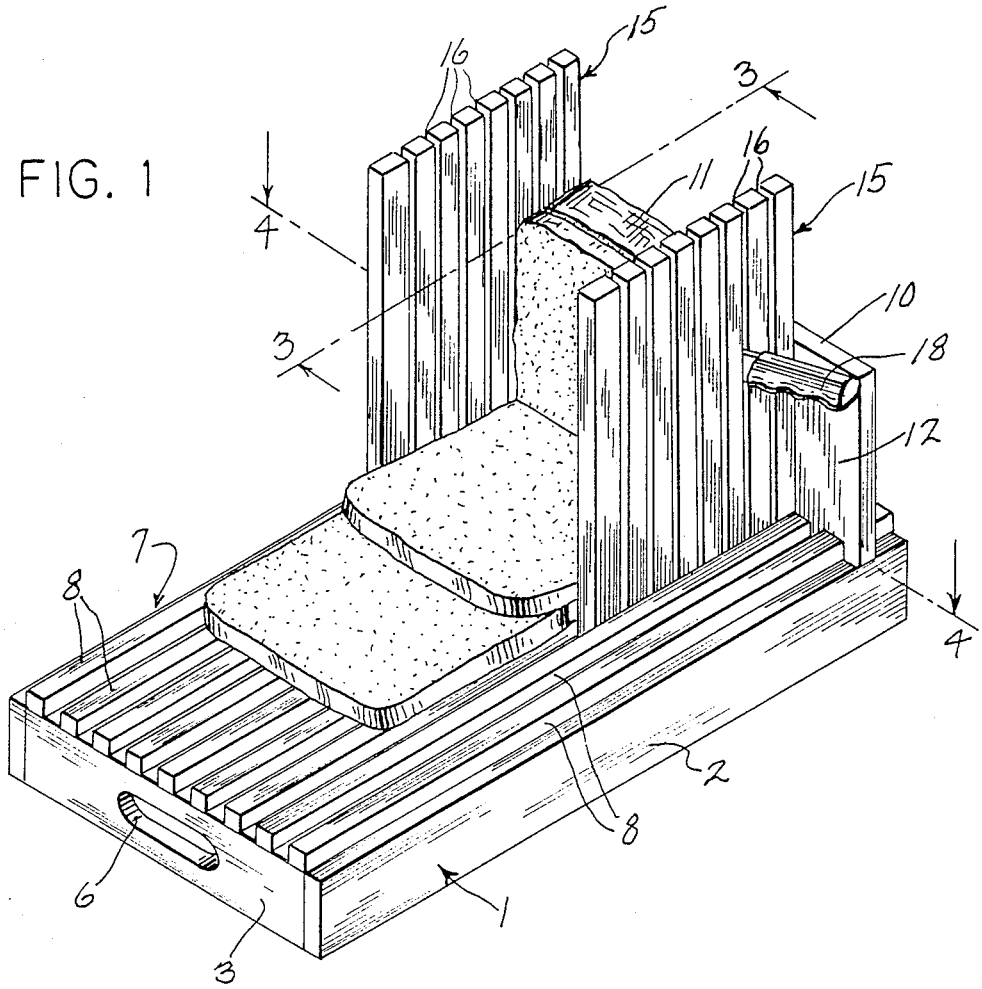
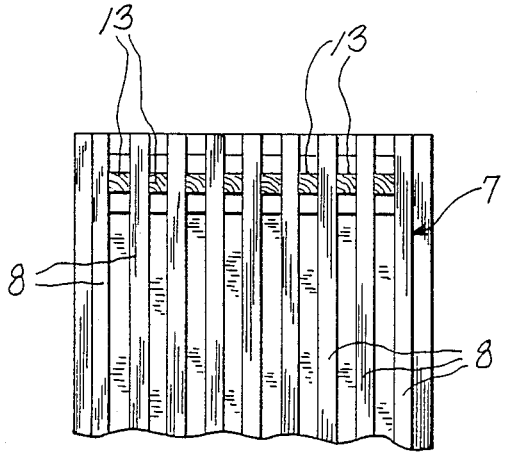
FIG. 4
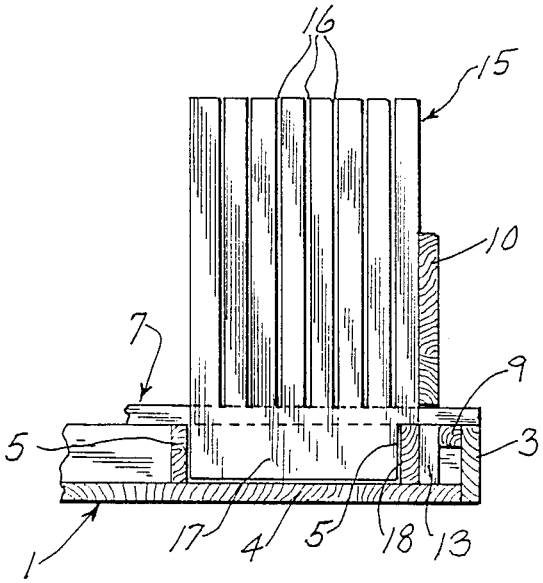
FIG. 3

BREAD CUTTING APPARATUS

BACKGROUND OF THE INVENTION

While sliced bread is readily available, many people prefer unsliced bread as purchased at a bakery or as baked at home.

Various types of bread slicing devices have been proposed in the past. In general, the bread slicing devices have consisted of a board which supports the loaf and a pair of parallel sliding guides are mounted on the base and located on either side of the loaf. The guides contains slits or vertical surfaces, so that the knife can be guided in the slits or surfaces during the cutting operation. While devices of this type have been satisfactory in cutting slices from a bread loaf, some of the devices have not been adjustable for different widths of loafs and no provisions have been made for collection of crumbs and the devices are not readily cleanable after use.

SUMMARY OF THE INVENTION

The invention is directed to an improved bread cutting device. In accordance with the invention, the device includes an open top container or box and a tray is removably mounted on the box and includes a series of parallel spaced rails which support a loaf of bread to be cut.

An upstanding back stop is mounted at one end of the box and extends upwardly from the tray in position to be engaged by the end of the loaf. A pair of slicing guides are received within the spaces between adjacent rails and each guide includes a plurality of parallel slits that extend from the upper end of the guide to a location spaced from the lower end.

In use, the loaf to be cut is positioned on the rails of the tray and the slicing guides are located within the spaces between rails, so that the guides will be contiguous relation to the sides of the loaf. A knife is then inserted in aligned slits in the slicing guides and a slice can then be cut from the loaf, with the crumbs generated during slicing falling downwardly through the spaces between rails for collection in the box.

The bread cutting device of the invention is of simple and inexpensive construction and can be readily adjusted to receive loafs of different widths.

The components of the bread cutting device are preferably formed of wood and can be installed without the use of screws or auxiliary fasteners and can be readily disassembled for cleaning.

With the use of the spaced rails and the box, crumbs are collected in the box and the crumbs can then be emptied from the box at any convenient time.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the assembled bread cutting device;

FIG. 3 is a vertical section taken along line 3—3 of FIG. 1; and

FIG. 4 is a section taken along line 4—4 of FIG. 1.

DESCRIPTION OF THE ILLUSTRATED EMBODIMENT

Figure 2:
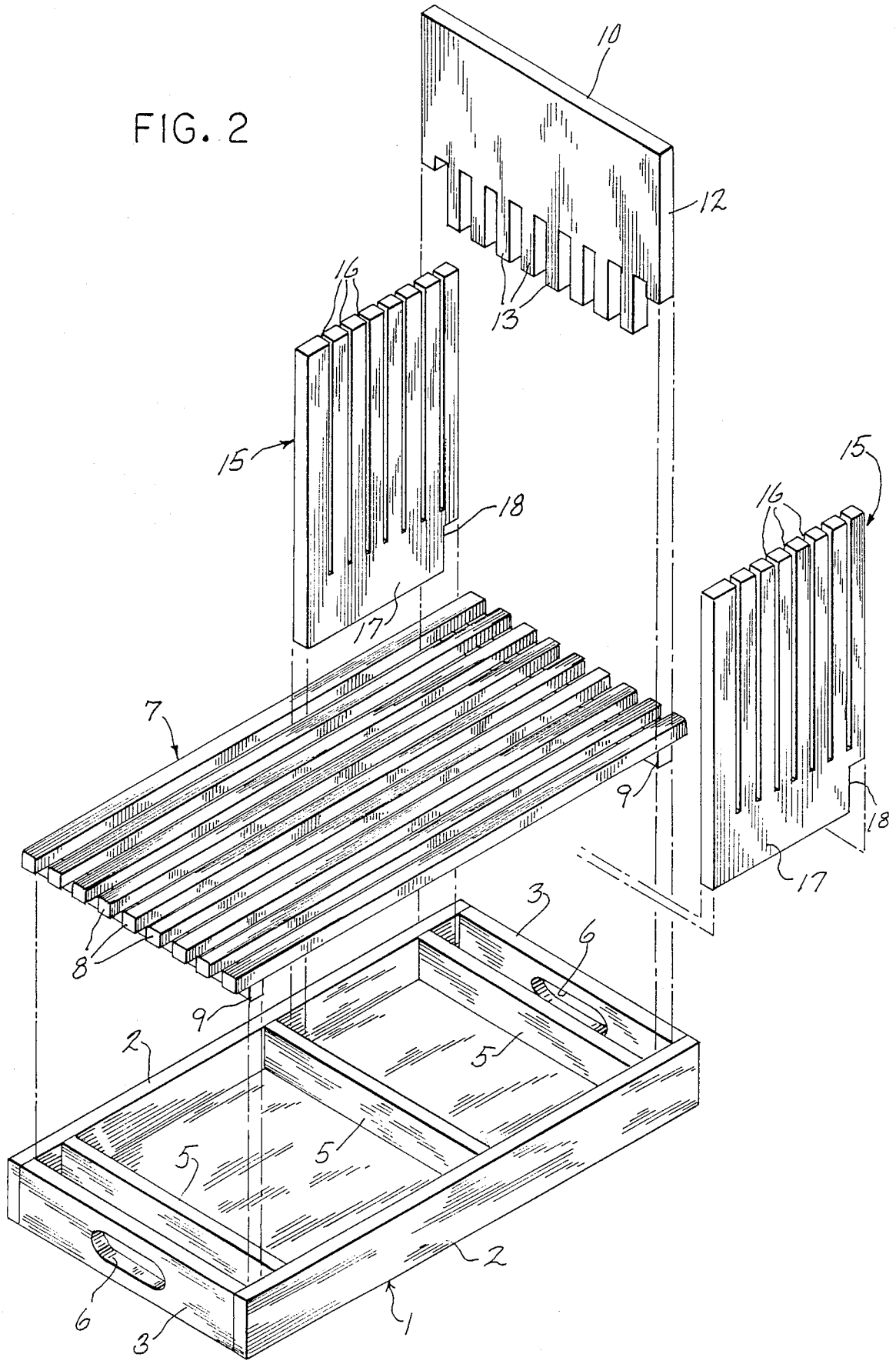
FIG. 2 is an explioded view of the device.

The drawing show an improved bread cutting device which includes an open top container or box 1, including a pair of side walls 2, a pair of end walls 3, and a bottom wall 4. A series of transverse walls 5 extend across the box and are parallel to end walls 3.

To facilitate handling of the bread cutting device, a pair of hand holes 6 can be provided in end walls 3.

A tray is supported on box 1, and includes a plurality of parallel spaced rails 8, the ends of which are joined by cross members 9. With the tray 7 supported on box 1, rails 8 project above the side walls 2 and end walls 3 of the tray. Cross members 9 are located inwardly of the respective end walls 3 and the ends of cross members 9 abut side walls 2, thus preventing both longitudinal and lateral movement of tray 7 on box 1.

A backstop 10 is located at one end of box 1 and serves to support the end of the loaf 11. Backstop 10 includes a generally vertical member 12 and a series of spaced parallel fingers 13 extend downwardly from the lower edge of vertical member 12 and are received in the spaces between rails 8 of tray 7 when the backstop 10 is assembled to the box. The lower ends of fingers 13 rest on the bottom wall 4 of the box, as seen in FIG. 3. The fingers 13 are trapped between cross member 9 and wall 5, thus maintaining backstop 10 in a vertical position.

A pair of slicing guides 15 are adapted to be mounted in spaced relation on tray 7 and straddle the loaf 11 to be cut. Each slicing guide 15 is provided with a plurality of parallel slits 16 and the slits extend from the upper end of each guide 15 to a location beneath rails 8 of tray 7. The lower ends 17 of guides 15 are received within the spaces between adjacent rails 8 and engage the bottom wall 4 of container 1. The lower end 17 of each guide 15 is provided with a notch 18 which mates with wall 5 located at the end of container 1 when the guide is in the assembled position.

In use, the loaf of bread 11 is positioned on tray 7, with the end of the loaf bearing against the backstop 10. One of the slicing guides 15 can then be adjusted in position by inserting the lower end 17 of the sliding guide within the desired space between rails 8, so that the slicing guides are in contiguous or contacting relation to the sides of the loaf. A knife 18 can then be inserted within the aligned slits 16 in guides 15 and operation of the knife will slice the loaf. Any crumbs that are generated during the slicing will fall downwardly through the spaces between rails 8 for collection in box 1.

It is contemplated that all of the components of the bread slicing device can be composed of wood or plastic, and the components can be readily assembled without the use of screws or any auxiliary fasteners. After use the components can be disassembled, the crumbs emptied from the box 1 and all of the components can be washed for reusage.

Various modes of carrying out the invention are contemplated as being within the scope of the following claims particularly pointing out and distinctly claiming the subject matter which is regarded as the invention.

I claim:

1. A bread cutting device, comprising a container having a bottom surface and an open top, a plurality of parallel spaced rails disposed across the open top of the container and located above said bottom surface, said rails being spaced apart to provide elongated openings therebetween, a backstop mounted on the container and disposed generally normal to said rails, said backstop including a generally vertical member and a plurality of generally vertical spaced parallel fingers extending from the lower end of said vertical member, said fingers being constructed and arranged to be received within said elongated openings, and a pair of slicing guides each having a lower end constructed and arranged to be received in one of said elongated openings, each guide including a plurality of parallel slits extending from the upper end of the guide to a location spaced from said lower end, a loaf of bread being adapted to be supported on said rails and by inserting a knife in aligned slits in said guides, a slice can be cut from the loaf with crumbs passing through the rails for collection in the container.

2. The device of claim 1, wherein said slicing guides having a greater height than said backstop.

3. The device of claim 1, and including a plurality of transverse walls extending laterally across said container, said rails being supported on said transverse walls, the lower ends of said guides being disposed between adjacent transverse walls.

4. The device of claim 1, wherein the lower extremities of said fingers are supported on the bottom surface of said container.

5. A bread cutting device, comprising a container having a pair of side walls and a pair of end walls and a bottom surface, a tray removably mounted on the container above said bottom surface and including a plurality of generally parallel spaced rails having elongated slots between adjacent rails, a backstop removably mounted to an end of the container, said backstop extending generally normal to said rails and extending upwardly from said rails, said backstop including a vertical member and a plurality of spaced parallel vertical fingers extending from the lower end of said vertical member, said fingers being constructed and arranged to be received within the slots between said rails, and pair of slicing guides each having a lower end constructed and arranged to be removably received in one of said slots, said guides including a plurality of generally parallel vertical slits extending from the lower end thereof, a loaf of bread adapted to be supported on said tray and by inserting a knife in aligned slits in said slicing guides a slice can be cut from said loaf with crumbs passing through said rails for collection in said container.

6. The device of claim 5, wherein said container, said tray, said backstop and said guides are composed of wood.

7. The device of claim 5, wherein said tray also includes at least one cross member extending transversely of said rails and disposed beneath said rails, said cross member being disposed in the container and in contact with one of said end walls, said container also having a transverse wall spaced from said cross member, said fingers being slidably received in the space between said transverse wall and said cross member to thereby maintain said backstop in an upright position.

8. A bread cutting device, comprising a container having a pair of side walls and a pair of end walls and a bottom surface, tray removably mounted on the container above said bottom surface and including a plurality of generally parallel spaced rails having elongated slots between adjacent rails, a backstop removably mounted to an end of the container, said backstop extending generally normal to said rails and extending upwardly from said rails, a pair of slicing guides each having a lower end constructed and arranged to be removably received in one of said slots, said slicing guides including a plurality of generally parallel vertical slits extending from the upper end of each slicing guide to a location spaced from the lower end thereof, and a transverse wall disposed in said container and extending normal to said rails, a side edge of the lower end of each slicing guide having a notch to receive said transverse wall, a loaf of bread adapted to be supported on said tray and by inserting a knife in aligned slits in said slicing guides a slice can be cut from said loaf with crumbs passing through said rails for collection in said container.

9. A bread cutting device, comprising a container having a pair of side walls and a pair of end walls and a bottom wall, said container also including a pair of spaced transverse walls extending between said sidewalls, a tray removably mounted on the container above said bottom surface and including a plurality of generally parallel spaced rails having elongated slots between adjacent rails, a backstop removably mounted to an end of the container, said backstop extending generally normal to said rails and extending upwardly from said rails, said backstop including a vertical member and a plurality of spaced parallel vertical fingers extending from the lower end of said vertical member and received within the slots between said rails, and a pair of slicing guides each having a lower end constructed and arranged to be removably received in one of said slots, the lower end of each slicing guide disposed between said transverse walls, said slicing guides including a plurality of generally parallel vertical slits extending from the upper end of each slicing guide to a location spaced from the lower end thereof, a loaf of bread adapted to be supported on said tray and by inserting a knife in aligned slits in said slicing guides a slice can be cut from said loaf with crumbs passing through said rails for collection in said container.

10. The device of claim 9 wherein a first of said transverse walls is spaced from a first of said end walls of the container, said tray including a cross member secured to the lower surfaces of said rails and disposed in the space between said first end wall and said first transverse wall and disposed adjacent said first end wall, the fingers of said backstop being disposed between said first transverse wall and said cross member.

11. The device of claim 10, wherein the lower end of each slicing guide has a notch to receive said first transverse wall.

12. The device of claim 9 wherein an end of each slicing guide is removably engaged with said backstop.

* * * * *